United States Patent [19]

Schiemann

[11] Patent Number: 4,881,652

[45] Date of Patent: Nov. 21, 1989

[54] DEVICE SUITABLE FOR USE AS A DUAL-CHAMBERED CAN

[76] Inventor: Wolfram Schiemann, Eugen-Nagele Strasse 17, 7140 Ludwigsburg, Fed. Rep. of Germany

[21] Appl. No.: 252,528

[22] Filed: Oct. 3, 1988

[51] Int. Cl.[4] ..... B65D 8/04

[52] U.S. Cl. ..... 220/20; 220/94 A; 222/129; 222/465.1

[58] Field of Search ..... 215/6; 220/20, 23.2, 220/23.8, 83, 94 A; 222/129, 142.1, 465.1, 475

[56] References Cited

U.S. PATENT DOCUMENTS

| | | | |
|---|---|---|---|
| 2,788,919 | 4/1957 | Bostwick | 222/129 |
| 2,826,338 | 3/1958 | Davis | 222/129 |
| 3,154,219 | 10/1964 | Dean et al. | 222/129 |
| 3,756,470 | 9/1973 | Bagwell et al. | 222/129 |
| 4,125,207 | 11/1978 | Ernst et al. | 220/94 A X |

FOREIGN PATENT DOCUMENTS

| | | | |
|---|---|---|---|
| 2149569 | 4/1973 | Fed. Rep. of Germany | 220/20 |

*Primary Examiner*—Gerald A. Michalsky

[57] ABSTRACT

A device suitable for use as a single-piece dual-chambered can of synthetic material, has a larger chamber for holding gasoline, a smaller chamber for holding oil, and a thin connecting member arranged between said chambers in the separation plane between the two said chambers and forming part of said chambers. Said device has on its upper side a handle stadddling the separation plane and possessing a root that begins on the upper side of said larger chamber. The said connecting member is non-linear along a considerable section of its length. The deviation from the linear is many times greater than the thickness of the connecting member.

6 Claims, 3 Drawing Sheets

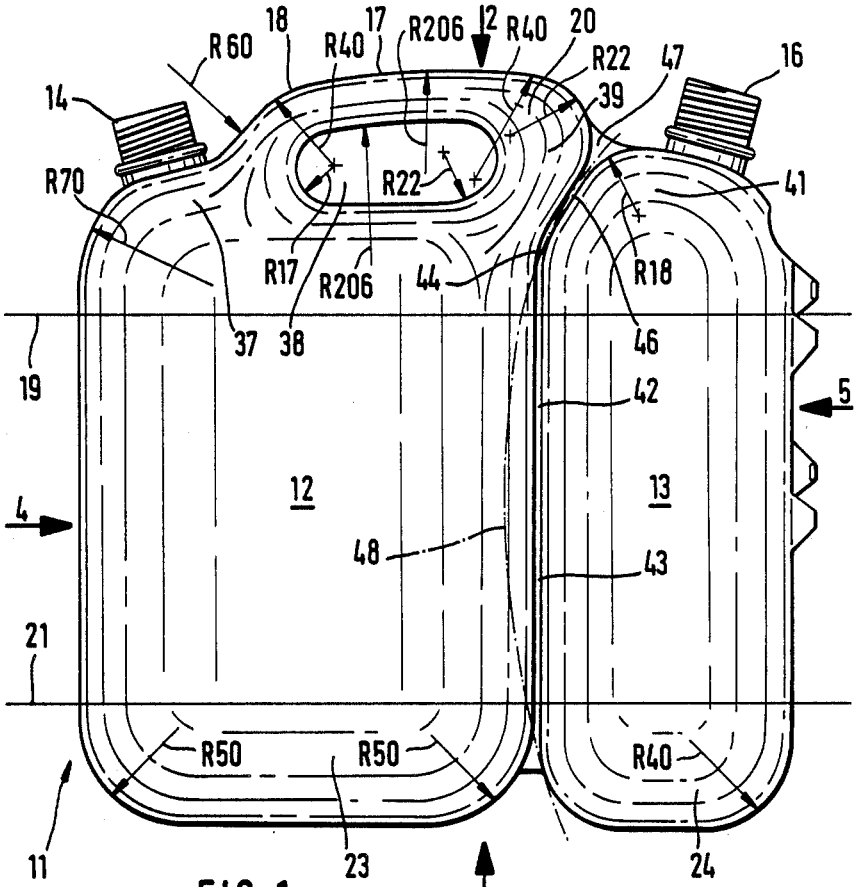
FIG. 1
FIG. 2
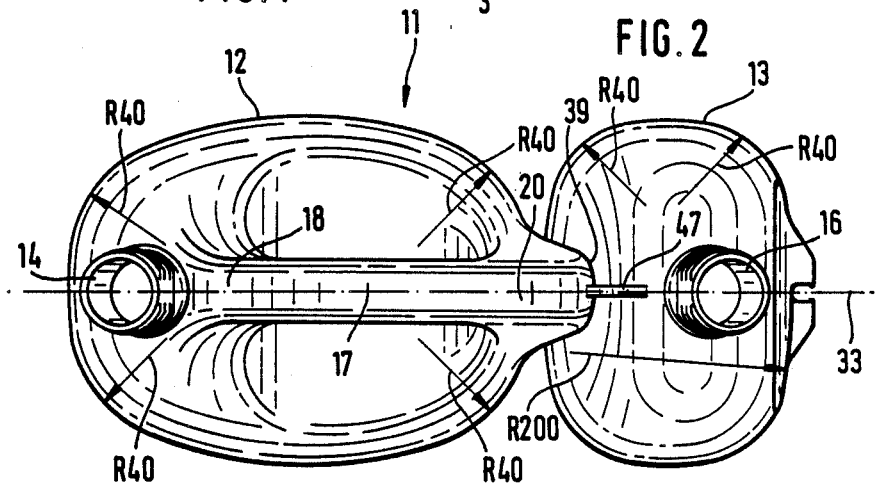

DEVICE SUITABLE FOR USE AS A DUAL-CHAMBERED CAN

The present invention relates to a device suitable for use as a one-piece dual-chambered can of synthetic material.

BACKGROUND OF THE INVENTION AND RELEVANT PRIOR ART

Such devices have a larger chamber for holding gasoline, a smaller chamber for holding oil, a separation plane between the chambers, and a thin connecting member arranged between the chambers in the separation plane and forming part of the chambers. A handle straddles the separation plane, and has a handle root that begins on the upper side of the larger chamber. Such a device is known from German Patent 21 49 569. Such cans are widely used by forest workers who operate chain saws powered by two-stroke engines. In practice, the two-stroke mixture is stored in the larger 5 liter chamber, while the smaller 2.5 liter chamber contains the chain lubricant. Clearly, this type of can can have many other uses. The disadvantages of this construction, which dates from 1971, are the following:

1. The thickness of connecting member 28 is somewhat less than double the thickness of the material used in construction, i.e. 5 mm. Such meagre dimensions do not provide the thickness required to separate both chambers. It must also be remembered that such cans, being produced by the blow-mold process, are rather less solidly constructed than injection-molded containers.

2. In order to remedy the instability of the connecting member, handle 3 was provided with roots, of which the first was affixed to the larger chamber, the second to the larger and smaller chambers and the third solely to the smaller chamber. This arrangement wastes material, since one need use only the handle that is situated over the center of gravity.

3. Blow-molding of this handle structure requires advanced techniques and relatively complicated blowing molds.

4. The above-mentioned second handle root limits the finger opening in the handle to a relatively small size, to the detriment of the user attempting to grasp the can, particularly if gloves are worn. There exists in Canada, for instance, a polar glove fashioned without individual finger pockets; such a glove could not possibly fit through a handle opening of this size.

5. The handle, also being blow-molded, features a cavity. Where no constriction point 34 made in the handle, the contents of the smaller chamber could be permitted to mix with the contents of the larger chamber, which would be inappropriate. The existence of such a constriction point would also weaken the handle, given the premise that a pipe composed of given quantity of material would exhibit the greatest strength if its load-bearing capacity were uncompromised in all directions.

6. It is not possible in this case to use the handle cavity for returning, during pouring, air to the rear of the larger chamber.

7. The rectilinear construction of the connecting member imposes at least upon upon the smaller chamber a somewhat flat rectangular shape, which has not proved to be especially resistant in impact tests.

OBJECT AND STATEMENT OF THE INVENTION

The object of the present invention is to provide a means of retaining the dual-chamber principle while simplifying the method of connecting the smaller chamber to the larger chamber.

The present invention satisfies this object as follows:

The connecting member deviates from linear along a considerable section of its length, and the deviation from linear is many times greater than the thickness of the connecting member.

The described embodiment includes the following additional advantageous features;

The connecting member is arranged outside of the handle. This permits the handle to be freely shaped according to specific need without special regard to the structure of the can.

The smaller chamber has an upper zone that extends cupola-like at least partway up to the height of the hand. The handle has a second handle root having a bulge that extends very close to the upper cupola-like zone. A second handle root emerges from the upper side of the larger chamber adjacent the upper cupola-like zone of the smaller chamber. The device has a floor zone on both of the chambers, and viewed from the side, the connecting member describes a curve from the floor zone to a zone situated between the second handle root and the upper cupola-like zone of the smaller chamber. This weds the nonlinearity of the connecting member to the cupola shape of the upper zone of the smaller chamber to provide impact resistance in the event of dropping. The handle is solidly joined to the connecting member, even at the point where the two chambers are no longer joined together. Such a shape furthermore facilitates the arrangement of a handle having a large grip opening. The shape of the connecting member, being bowed and dome-like, affords resistance against dropping and gas pressure buildup.

The curve comprises two sections: namely a first longer section that extends upward from the floor zone and a second shorter section that rises at a bend between the sections to form an obtuse angle with the longer section. This facilitates the production of the thin blow-molded wall and the subsequent cold drilling of holes therein. This procedure would not be as simple were the connecting member bent throughout.

The two sections are at least essentially linear. Preferably, both of the sections are linear. This augments the above-mentioned advantages.

The second handle root is considerably thicker in the zone of the second section than the first handle root, and the second handle root protrudes in the manner of a chin over the smaller chamber, and then curves inwardly. This enables the second handle root to better absorb the forces transferred to it from the connecting member. This condition, which applies especially to the upper cupola-shaped zone of the smaller chamber, also permits the second handle root to absorb the force of blows upon it.

The handle is hollow and has a lumen that connects exclusively to the larger chamber. This provides for a pathway for the return of air to the can.

The handle has an upper cross member and a second handle root that together posses a saxophone-like shape. This provides for uninterrupted points of contact between the two containers, which improves production, optimizes wall thickness, enhances load-bearing capacity etc.

The device has radii that can vary minus/plus 30%.

DESCRIPTION OF THE DRAWINGS

The present invention shall next be described in greater detail by means of drawings of a preferred embodiment thereof.

FIG. 1 is a side view of the proposed can;

FIG. 2 is a view as indicated by arrow 2 of FIG. 1;

DETAILED DESCRIPTION OF A PREFERRED EMBODIMENT

Figure 3:
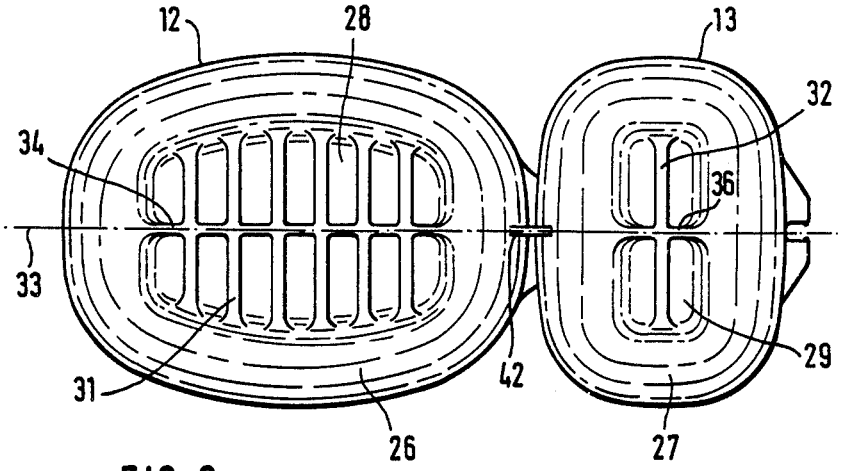
FIG. 3 is a view as indicated by arrow 3 of FIG. 1.
Figure 4:
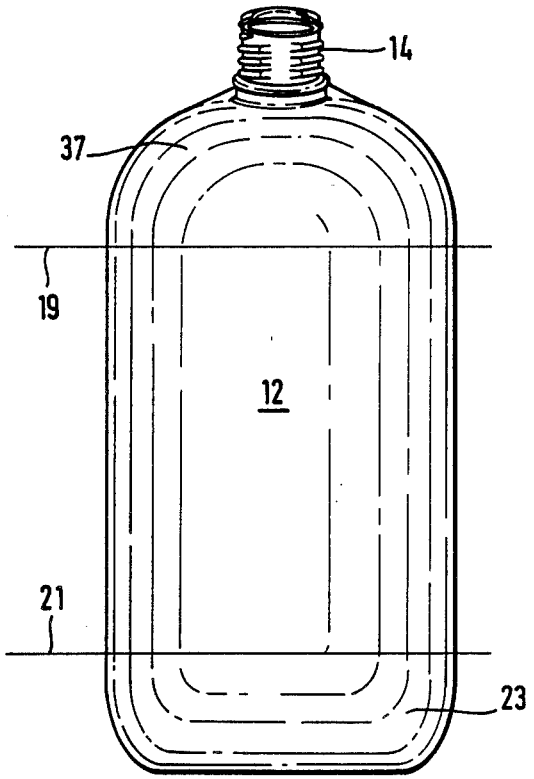
FIG. 4 is a view as indicated by arrow 4 of FIG. 1.
Figure 5:
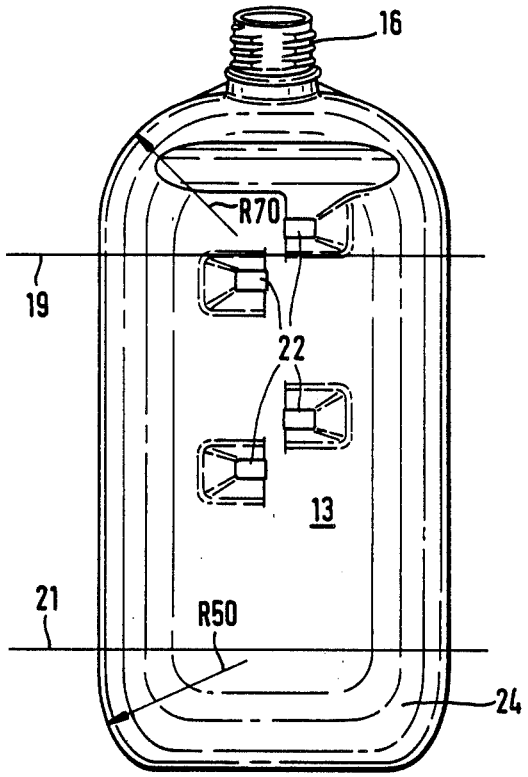
FIG. 5 is a view as indicated by arrow 5 of FIG. 1.

A dual-chambered can 11 is blow-molded from a synthetic material. The larger of its two chambers 12 holds 5 liters of liquid, whereas the smaller chamber 13 holds 2.5 liters. The larger chamber 12 possesses, in accordance with FIG. 1, a leftfacing, integrally-produced threaded neck 14, and the smaller chamber 13 has a right-facing integrally-produced threaded neck 16.

Emerging from the upper side of chamber 12 is a handle 17, having in the zone near threaded neck 14 a smaller handle root 18, as well as a larger handle root 20. The wall thickness of the synthetic material lies between 3 and 4 mm. The section of wall located between lines 19 and 21 is, with the exception of the bowed-out portions 22 (which shall not concern us here) -- in the form of a straight line that runs parallel to the datum plane of FIG. 1, or, rather, perpendicular to the surface upon which the dual chambered can 11 naturally sits.

Chamber 12 exhibits below line 21, the form of a flat, downwardly-oriented support dome 23 featuring large radii. Support dome 24 of the smaller chamber 13 also features large radii. The radii, in both cases, extend to the oval support surface 26 of the larger chamber 12 and up to the more rectangular support surface 27 of the smaller chamber 13.

As FIG. 3 in particular demonstrates, the outline of smaller chamber 12 is rectangular with highly rounded corners, whereas larger chamber 13 is in this view elongated rectangular/oval with well-rounded corner radii. Such radii are in this respect larger in the larger chamber 12 than the corresponding radii of the smaller chamber 13, which prevents the vapour pressure developing in chamber 12 from significantly changing the basic shape of the can. The individual radii are shown in the drawing.

The central zone of the support surfaces, represented by 28 and 29 is depressed inwardly, in order to prevent the bottom of the can from resting directly on the ground, if the latter is fairly even. The central zones of the can bottom 28, 29, are reinforced either by wide cross members 31 or by one cross member 32. To the left and right of a medial plane of symmetry, cross members 31 and 32 are intersected by longitudinal members 34, 36 whose width is equal to that of such cross members. Chamber 12 rises above line 19 to merge into a large-radius cupola 37, which curves upward to the left to support threaded neck 14. The first handle root 18, which begins a short distance to the right of threaded neck 14, is considerably narrower than the width of threaded neck 14, maintains this cross section along practically the entire length of handle opening 38, and then widens so that the width of the second handle root 20 extends the practically 40mm diameter of threaded neck 16. As FIG. 1 illustrates, handle root 20 extends to the right with a protuding chin 39 into a zone that partially overlaps chamber 13. Two thirds of the length of handle 17 lying to the right-hand side has a shape not unlike that of a saxophone. Handle opening 38 is large enough to accomodate winter gloves. The middle of handle 17 sits more or less over the common centre of gravity of dualchambered can 11, when both chambers 12 and 13 are filled with liquid.

Chamber 13 rises above line 19 to form a cupola 41 having very large radii and supporting threaded neck 16. The left-hand zone of cupole 41 follows the undercontour of chin 39.

Chambers 12 and 13 are joined together by means of a connecting member 42 that is approximately 5 mm thick and comprises a first linear section 43 that begins a short distance below line 21 and follows perpendicular medial plane of symmetry 33 to the top. The thickness of linear section 43 —like the entire connecting member 42, 3–4 mm —merges at a 45° bend 44 into a shorter linear section 46 that is basically equal in length to the underside of chin 39. Because cupola 41 conforms closely to chin 39, section 46 has only to be a few millimeters thick. Component 46 merges at the top into a delta 47, resembling a small fishtail.

The non-linearity of connecting member 42 does not necessarily have to be produced in the manner described in the embodiment example given. In the example described, the ratio of long sections to short sections would be about 4:7. This ratio could vary upwardly or downwardly by 10%.

The non-linearity of connecting member 42 can also be achieved by bending connecting member 42 into an arc as indicated by the dotted line 48.

What is claimed is:

1. Device suitable for use as a one-piece dual-chambered can of blow-molding synthetic material said device having a larger chamber for holding gasoline, a smaller chamber for holding oil, a separation plane between said chambers, a thin connecting member arranged between said chambers in said separation plane and forming part of said chambers, an upper side on said larger chamber and a handle straddling said separation plane, said handle having a handle root that begins on said upper side of said larger chamber, wherein:

(a) said connecting member is arranged outside of said handle, (b) said smaller chamber has an upper zone that extends cupola-like at least partway up the height of said handle, (c) said handle has a second handle root having a bulge that extends very close to said upper cupola-like zone of said smaller chamber, (d) said second handle root emerges from said upper side of said larger chamber adjacent said upper cupola-like zone of said smaller chamber, (e) said device has a floor zone on both of said chambers, and viewed from the side, said connecting member describes a curve from said floor zone to a zone situated between said second handle root and said upper cupola-like zone of said smaller chamber, (f) said curve comprises a first longer section that extends upward from said floor zone and a second shorter section that rises at a bend between said first and second sections to form an obtuse angle with said first section, and (g) said second handle root is considerably thicker in the zone of said second section than said first handle root, and said second handle root protrudes in the manner of a chin over said smaller chamber and then curves inwardly.

2. Device in accordance with claim 1, wherein said first and second sections are at least essentially linear.

3. Device in accordance with claim 1, wherein both of said first and second sections are linear.

4. Device in accordance with claim 1, wherein said handle is hollow and has a lumen that connects exclusively to said larger chamber.

5. Device in accordance with claim 1, wherein said handle has an upper cross member and a second handle root that together possess a saxophone-like shape.

6. Device in accordance with one of claims 1 , 2-3, and 4-5, wherein said device has radii that can vary minus/plus 30%.

* * * * *